US006335489B1

(12) United States Patent
Kobayashi et al.

(10) Patent No.: US 6,335,489 B1
(45) Date of Patent: Jan. 1, 2002

(54) CONNECTING DEVICE FOR HIGH-VOLTAGE CABLE

(75) Inventors: Yoshinao Kobayashi; Masuhiro Kiryu, both of Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/493,680

(22) Filed: Jan. 28, 2000

(30) Foreign Application Priority Data

Jan. 28, 1999 (JP) ..... 11-019629

(51) Int. Cl.[7] ..... H01R 4/10
(52) U.S. Cl. ..... 174/84 C
(58) Field of Search ..... 174/84 C, 74 R, 174/102 SC, 94 R, 88 R; 439/492, 422

(56) References Cited

U.S. PATENT DOCUMENTS

| | | | | |
|---|---|---|---|---|
| 3,596,236 A | * | 7/1971 | Shlesinger, Jr. | 174/84 C |
| 4,199,211 A | * | 4/1980 | Kidder | 174/84 C X |
| 4,921,443 A | * | 5/1990 | Sato | 439/521 |
| 4,949,454 A | * | 8/1990 | Schauer et al. | 174/84 C X |
| 5,413,500 A | | 5/1995 | Tanaka | 439/521 |
| 5,486,653 A | * | 1/1996 | Dohi | 174/84 C |
| 5,532,433 A | * | 7/1996 | Endo et al. | 174/84 C |
| 5,576,514 A | * | 11/1996 | Fujimoto et al. | 174/120 SC X |

FOREIGN PATENT DOCUMENTS

| | | |
|---|---|---|
| JP | 310869 | 2/1970 |
| JP | 548421 | 11/1980 |
| JP | 593652 | 10/1982 |
| JP | 593653 | 10/1982 |
| JP | 601613 | 2/1983 |
| JP | 602500 | 3/1983 |
| JP | 635597 | 7/1984 |
| JP | 721460 | 8/1987 |
| JP | 522949 | 1/1988 |
| JP | 735481 | 2/1988 |
| JP | 6-269929 | 9/1994 |
| JP | 8-281753 | 10/1996 |

OTHER PUBLICATIONS

English language abstract of JP 6–269929.
English language abstract of JP 8–281753.

* cited by examiner

*Primary Examiner*—Chau N. Nguyen
(74) *Attorney, Agent, or Firm*—Greenblum & Bernstein, P.L.C.

(57) ABSTRACT

To improve noise suppression, there is provided a metallic connecting device for connecting a high-voltage electrical cable to a transformer. To further enhance the above effect, a coiled-type high-voltage noise-suppressing cable is used as the high-voltage electrical cable. The connecting device includes a crimping connector portion where the coiled-type high-voltage noise-suppressing cable is press-fitted, and a solder connector portion where a connector portion of transformer is fixed by soldering. The crimping connector portion may include a first barrel portion, a second barrel portion and a detent which is formed by notching and raising part of the base wall of the crimping connector portion. The solder connector portion is in the form of a cup, and the base center of the solder connector portion includes a through hole having a diameter slightly greater than that of the connector of transformer.

19 Claims, 6 Drawing Sheets

CONNECTING DEVICE FOR HIGH-VOLTAGE CABLE

BACKGROUND OF THE INVENTION

1. Field of the Invention

The present invention relates to a connecting device used for connecting a high-voltage cable to a connector portion provided in a transformer. The transformer generates a high electrical voltage. The high electrical voltage thus produced is applied to electrical apparatuses, such as office or home appliances for different purposes. The connecting device according to the invention is used for sending the high electrical voltage to the electrical apparatuses. Further, the invention concerns methods of connecting such a high-voltage cable to a transformer.

2. Description of Background Information

FIG. 1 shows a known connecting technique, according to which a high-voltage cable used for sending a high electrical voltage is connected to a connector portion 3 of a transformer 1 in such electrical apparatuses. With this technique, once a connector portion 3 of the transformer 1 is connected to a high-voltage cable 5 for sending a high electrical voltage, there is no need to detach them. Accordingly, the high-voltage cable 5 is stripped off of its coating, thereby yielding a conductive portion 5*a,* and the conductive portion 5*a* is soldered to the connector portion 3 of transformer 1.

The transformer 1 comprises a vertically-extending housing 7. The housing 7 contains a primary coil and a secondary coil which generate high electrical voltages as a function of the inputted variable current. The housing 7 may also contain various electronic parts such as condensers, diodes or impedance elements, connected to each coil. The housing 7 is provided with a hollow portion 7*a* and a base from which a connector portion 3 of the transformer 1 extends into the hollow portion 7*a*. The end portion of the secondary coil of transformer 1 may thus be connected to an electronic component. The latter includes an end section which may form a rod-shaped terminal portion. Accordingly, the connector portion 3 of transformer 1 may be comprised of the terminal portion of an impedance element, e.g. a capacitor in the housing 7. However, the connector portion 3 of transformer 1 may also be comprised of a lead wire extending from the electronic component.

The high-voltage cable 5 usually has a conductive portion 5*a* consisting of a plurality of copper wires, and a resin coating. When the high-voltage cable 5 is connected to a connector portion 3 of transformer 1, an epoxy resin or the like is filled into the hollow portion 7*a,* so that the connected portion between the high-voltage cable and the connector portion 3 of the transformer 1 is sealed with the resin. Thereafter, a rubber grommet 9 is fitted onto part of the circular peripheral zone of the high-voltage cable 5. The hollow portion 7*a* of housing 7 includes a rectangular side chamber, whose outermost face has a notch 7*b* vertically atop thereof. After the high-voltage cable 5 has been mounted into the housing 7, the space formed between the notch 7*b* and the high-voltage cable 5 is closed by the rubber grommet 9, such that the sealing resin is prevented from overflowing.

When the transformer 1 generates a high electrical voltage, it also generates noise through the high-voltage cable 5, and hence a countermeasure for reducing noise becomes necessary. To this end, either a magnetic core is set around the cylindrical outer surface of the high-voltage cable 5, or an impedance element is inserted in the conductive part of the high-voltage cable 5 so as to curb the noise current flowing in the high-voltage cable 5. However, these methods yield only a limited effect, and there is a need for a more efficient noise-suppressing technique.

To further improve noise-suppressing efficiency, a coiled-type, high-voltage noise-suppressing cable may be used, instead of the high-voltage cable 5. The coiled-type, high-voltage noise-suppressing cable comprises at least a core element of magnetic material, a coiled portion at least including a conductive wire for passing a high electrical voltage. The coil is helically wound around the core element, and a coating entirely covers the core element and coiled portion. Such a structure is designed to suppress noise efficiently.

The conductive wires commonly used in a coiled-type cable for preventing high-voltage noise include wires such as nickel-chromium wires. However, such conductive wires are ill suited for soldering. Accordingly, when using the above technique, the high-voltage cable 5 cannot be soldered directly to the connector portion 3 of the transformer 1.

SUMMARY OF THE INVENTION

An object of the present invention is to provide a connecting device with improved noise-suppressing capacity using a coiled-type cable for preventing high-voltage noise and which can easily connect the coiled-type, high-voltage noise-suppressing cable to a transformer, as well as to provide a method of connecting the coiled-type, high-voltage noise-suppressing cable to the transformer.

To this end, according to one aspect of the present invention, there is provided a metallic connecting device for connecting a high-voltage electrical cable to a transformer having a connector portion from which a high electrical voltage is outputted. The high-voltage electrical cable includes a coiled-type high-voltage noise-suppressing cable including at least a coiled core element containing a magnetic material and at least a conductive wire through which the high electrical voltage is passed, the conductive wire being wound around the magnetic material, and a coating covering the coiled core element.

The connecting device includes a crimping connector portion adapted for press-fitting the coiled-type high-voltage noise-suppressing cable, and a solder connector portion formed in extension of the crimping connector portion and adapted for connecting to the connector portion of the transformer by soldering.

In another aspect of the present invention, the transformer is provided with an electronic part including a rod-shaped terminal portion. The connector portion of the transformer may include the rod-shaped terminal portion, while the solder connector portion of the connecting device may be substantially in the form of a cup having a base with a through hole. The rod-shaped terminal portion is then passed through the through hole, and connected and fixed to the solder connector portion by soldering.

Alternatively, the solder connector portion of the metallic connecting device may include a substantially flat plate which is put into contact with the rod-shaped terminal portion along the length direction thereof. The rod-shaped terminal portion is then connected and fixed to the solder connector portion by soldering.

In a further alternative, the solder connector portion of the connecting device may include a pair of lips extending substantially in parallel, between which the rod-shaped terminal portion is inserted. The rod-shaped terminal portion is then connected and fixed to the solder connector portion by soldering.

When using the metallic connecting device of the invention, the coiled-type high-voltage noise-suppressing cable typically includes an end portion which is stripped of its coating so that the coiled portion is exposed. The crimping connector portion may include a first barrel portion in which the coiled portion of the coiled-type high-voltage noise-suppressing cable is press-fitted, and a second barrel portion in which the coiled-type high-voltage noise-suppressing cable is crimped from above its coating.

Advantageously, the second barrel portion includes a base wall and a detent formed on the base wall.

According to another aspect of the present invention, there is also provided a method of connecting a transformer containing a connector portion to a high-voltage electrical cable having an end portion. The method includes: a) preparing a coiled-type high-voltage noise-suppressing cable used as a high-voltage electrical cable, the coiled-type high-voltage noise-suppressing electrical cable including a coiled core element containing a magnetic material and a coiled portion, the coiled portion including a conductive wire through which a high electrical voltage is passed, the conductive wire being wound around the magnetic material, and a coating covering the coiled core element.

The method also includes: b) stripping the end portion of the coating so that the coiled portion is exposed, and c) preparing a connecting device. The metallic connecting device includes a crimping connector portion adapted for press-fitting the coiled-type high-voltage noise-suppressing cable, and a solder connector portion provided in extension of the crimping connector portion and adapted for connecting the connector portion of the transformer to the end portion of coiled-type high-voltage noise-suppressing cable by soldering.

The method further includes: d) press-fitting the coiled-type high-voltage noise-suppressing cable in the crimping connector portion, while connecting and fixing the end portion of the coiled-type high-voltage noise-suppressing cable to the connector portion of the transformer by soldering at the solder connector portion, whereby the transformer is connected and fixed to the coiled-type high-voltage noise-suppressing cable via the metallic connecting device.

BRIEF DESCRIPTION OF THE DRAWINGS

The above and other objects, features and advantages of the present invention will be made apparent from the following description of the preferred embodiments, given as non-limiting examples, with reference to the accompanying drawings, in which.

DETAILED DESCRIPTION OF THE PREFERRED EMBODIMENTS

Figure 2:
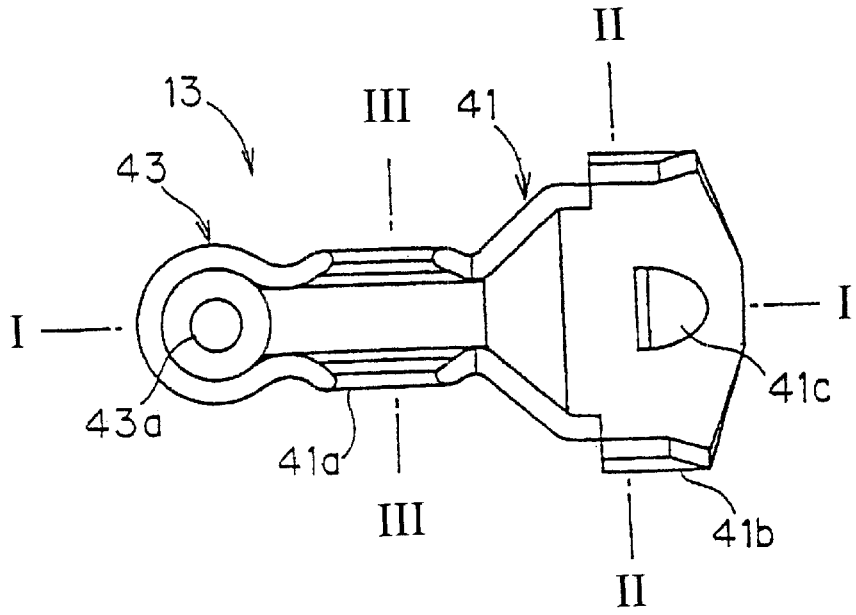
FIG. 2 is a top plan view of a metallic connecting device according to a first embodiment of the present invention.
Figure 3:
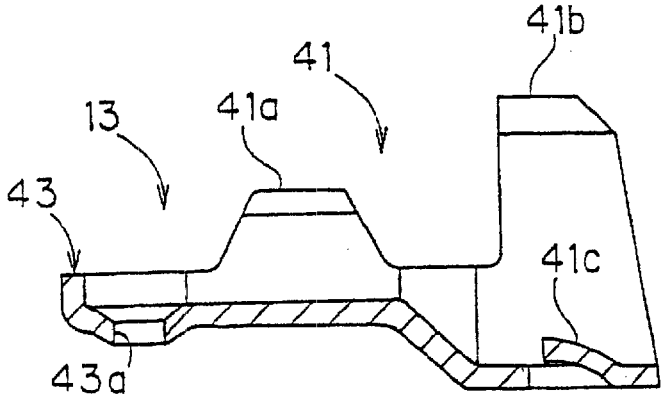
FIG. 3 is a cross-sectional side view of the connecting device of FIG. 2 along line I—I.
Figure 4:
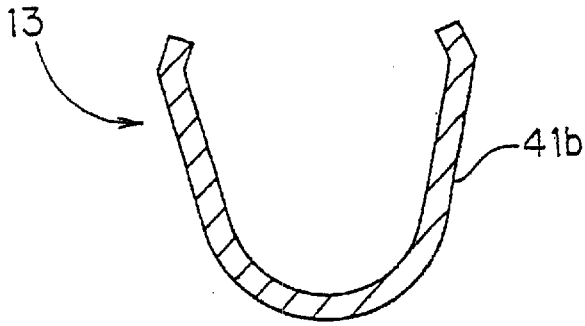
FIG. 4 is a transverse cross-sectional view of the connecting device of FIG. 2 along line II—II.
Figure 5:
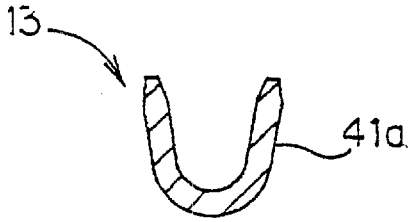
FIG. 5 is a transverse cross-sectional view of the connecting device of FIG. 2 along line III—III.
Figure 6:
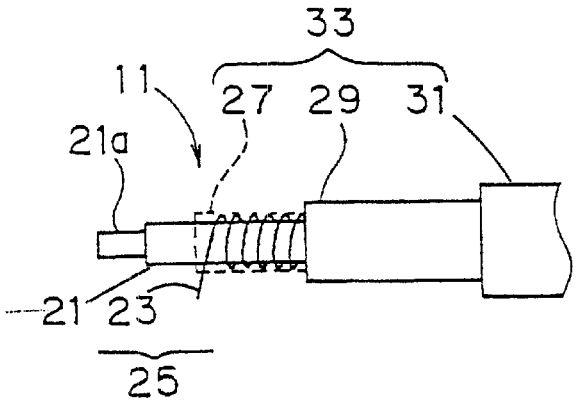
FIG. 6 is a partially exploded side view of a coiled-type high-voltage noise-suppressing cable which is connected to a transformer via the connecting device of FIG. 2.

FIG. 2 is a top plan view of the metallic connecting device according to a first embodiment of the present invention. FIGS. 3, 4 and 5 are, respectively, cross-sectional view of the connecting device along lines I—I, II—II and III—III of FIG. 2. FIG. 6 is a partially exploded view of a coiled-type high-voltage noise-suppressing cable. This cable is connected to a transformer through a metallic connecting device according to the invention.

Figure 1:
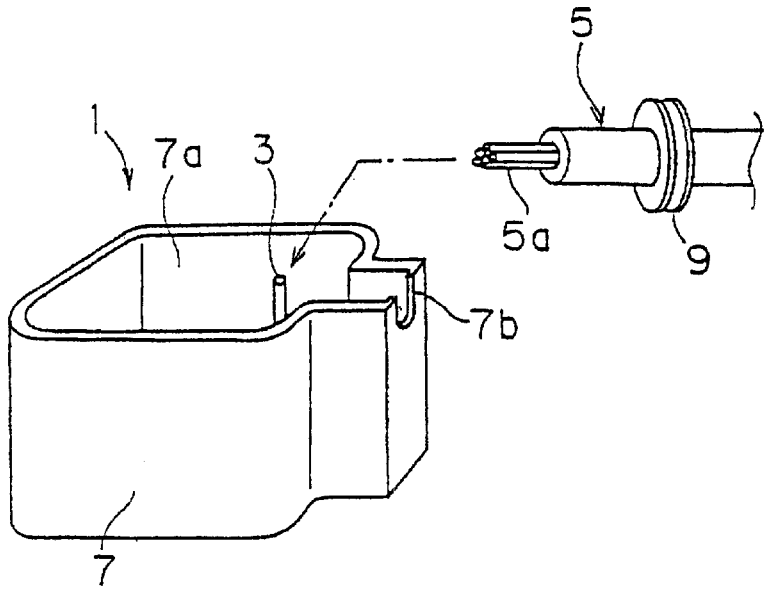
FIG. 1 PRIOR ART
FIG. 1 is a perspective view showing how a high-voltage electrical cable is connected to a transformer according to a known technique.

According to the embodiments of the present invention, commonly known high-voltage electrical cables 5 are replaced by coiled-type high-voltage noise-suppressing cables 11 (hereinafter referred to as "noise-suppressing electrical cable") shown in FIG. 6. The noise-suppressing electrical cable 11 is connected to a connector portion 3, mounted in a transformer 1 as shown in FIG. 1, via a connecting device 13 shown in FIGS. 2 to 5. Otherwise, the configuration of transformer 1 used is the same as the known one. As in the known techniques, the hollow portion 7*a* of transformer 1 is filled with resin after a noise-suppressing electrical cable 11 has been connected. Likewise, the space formed between the noise-suppressing electrical cable 11 and the notched portion 7*b* of the housing 7 is sealed by a rubber grommet 9.

The noise-suppressing electrical cable 11 used in the present embodiments has the following technical features. As shown in FIG. 6, this cable 11 first includes a fibrous reinforcement thread 21*a* formed of glass fibers and synthetic fibers. A resin material mixed with ferrite powder (a magnetic material) is then extruded thereon, yielding a core element 21 having a small diameter. Subsequently, a conductive wire 23 for sending a high-electrical voltage is wound around the core element 21, to form a coiled portion 25. Thereafter, the cylindrical outer surface of the coiled portion 25 is covered with a coating 33 comprising a conductive internal layer 27, an insulating layer 29 and an external sheath 31.

As shown in FIGS. 2 to 5, the metallic connecting device 13 may be integrally formed by a stamping method from a single metal piece. One end of the connecting device 13 has a crimping connector portion 41 into which a noise-suppressing electrical cable 11 is press-fitted. The other end of connecting device has a solder connector portion 43, to which a connector portion 3 mounted in the transformer 1 (FIG. 1) is soldered.

As shown in FIGS. 4 and 5, the crimping connector portion 41 has a generally U-shaped cross-section. The crimping connector portion 41 may include a first barrel portion 41*a* located at a position to be fitted with the edge side of noise-suppressing electrical cable 11, a second barrel portion 41*b* located at a position farther therefrom, and a detent 41*c*. The detent 41*c* is cut out from the base wall of the second barrel portion 41*b* and raised inwardly therefrom so as to project into the second barrel portion.

Figure 7:
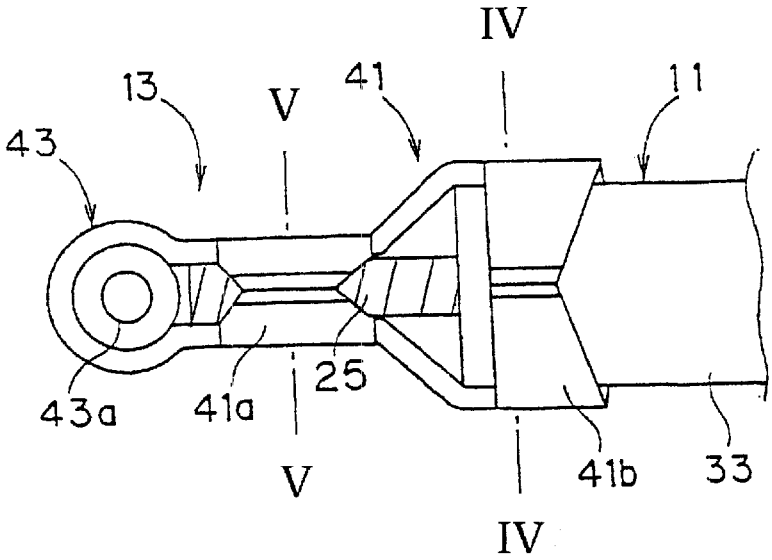
FIG. 7 is a top plan view of the metallic connecting device of FIG. 2 when it is press-fitted to the coiled-type high-voltage noise-suppressing cable of FIG. 6.
Figure 8:
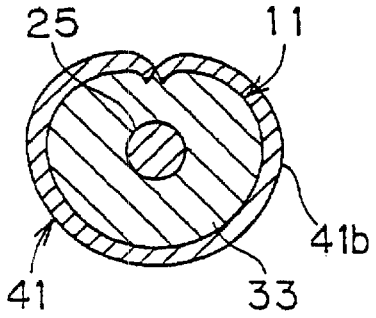
FIG. 8 is a transverse cross-sectional view of the connecting device of FIG. 7 along line IV—IV.
Figure 9:
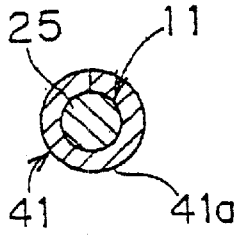
FIG. 9 is a transverse cross-sectional view of the connecting device of FIG. 7 along line V—V.

In the first barrel portion 41*a,* shown in FIGS. 7 and 9, a coiled portion 25 is exposed by stripping off the coating 33 from the end portion of noise-suppressing electrical cable 11. The bare coiled portion 25 is then press-fitted into the first barrel portion 41*a* and held therein. In the second barrel portion 41*b,* shown in FIGS. 7 and 8, the coated end portion of noise-suppressing electrical cable 11 is crimped from over its coating 33 and held in the second barrel portion 41*b*.

As shown in FIG. 8, the second barrel portion 41*b* is longitudinally open, so as to form two longitudinal edges, and holds the noise-suppressing electrical cable 11 by penetrating the longitudinal edges into the coating 33. By contrast, as shown in FIG. 9, the longitudinal edges of first barrel portion 41*a* hold the coiled portion 25 by wrapping, but without cutting into it. The connector portion 3 of the transformer is thus press-connected to the conductive wire 23 contained in the coiled portion 25.

Figure 10:
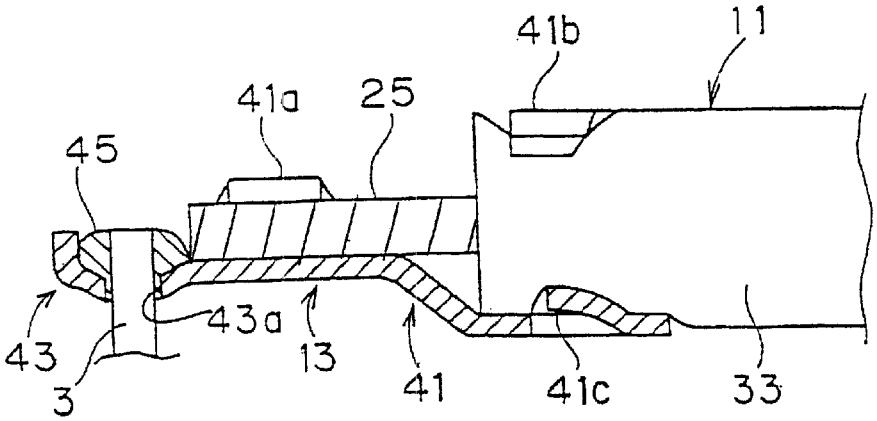
FIG. 10 is a cross-sectional side view of the connecting device of FIG. 2, when it is soldered to a transformer while press-fitted to the coiled-type high-voltage noise-suppressing cable.

As shown in FIG. 10, the detent 41*c* is formed by notching part of the base and raising it up along a fulcrum line such that its edge becomes inclined towards the advancing direction of the electrical cable. Accordingly, when the noise-suppressing electrical cable 11 is fixed into the crimping connector portion 41, the edge of detent 41*c* penetrates into the noise-suppressing electrical cable 11, so that the latter is prevented from moving back. In this compressed state, the detent 41*c* continuously presses against the outer surface of noise-suppressing electrical cable 11 along the diametrically inward direction by its elastic force.

In the first embodiment of the invention, shown in FIGS. 2 and 3, the solder connector portion 43 is in the form of a cup, the base center of which is provided with a through hole 43*a* having a diameter slightly greater than that of the connector portion 3 of transformer 1 (see FIG. 1).

When a noise-suppressing electrical cable 11 is connected to a transformer 1, the end portion of the noise-suppressing electrical cable 11 is first stripped of its coating 33. The noise-suppressing electrical cable 11 having the end portion thus prepared is then inserted into a crimping connector portion 41 of metallic connecting device 13 and press-fitted therein as shown in FIGS. 7 to 9. The connector portion 3 of transformer 1 is then inserted into the solder connector portion 43 of the connecting device 13 via the through hole 43*a* from the base side of the solder connector portion 43 (see FIG. 10). Subsequently, the solder connector portion 43 and the connector portion 3 of the transformer 1 are joined by soldering. Since the solder connector portion 43 is in the form of a cup, the solder 45 forms a mass inside the cup and solidifies. The solder connector portion 43 is thus firmly soldered.

According to the above described embodiment, the noise-suppressing electrical cable 11 can be connected to the transformer 1 by means of a connecting device 13. Because the noise-suppressing electrical cable 11 is used as a high-voltage cable, noise suppression is further improved, compared to the other types of high-voltage cables. Furthermore, the connections between the connecting device 13 and the noise-suppressing electrical cable 11 on the one hand, and between the connecting device 13 and the transformer 1 on the other, are obtained simply by crimping or soldering. The noise-suppressing electrical cable 11 can thus be easily, but reliably, connected to the transformer 1.

Further, the solder connector portion 43 of connecting device 13 is in the form of a cup having a base center which is provided with a through hole 43*a*. By virtue of this configuration, the connector portion 3 of transformer 1 can be inserted into the cup-shaped solder connector portion 43 from the base side thereof, via the through hole 43*a*. Thereafter, the solder connector portion 43 is fixed by soldering. The solder 45 then forms a mass in the solder connector portion 43, so that the solder connector portion 43 is firmly soldered to the connector portion 3 of transformer 1. Further, the soldering process is easily carried out, for example, by dripping molten solder onto the solder connector portion 43. The soldering process is thus simplified.

Moreover, the crimping connector portion 41 of connecting device 13 may include a first barrel portion 41*a* in which the coiled portion 25 at the bared end portion of the noise-suppressing electrical cable 11 is held by press-fitting. The crimping connector portion may further include a second barrel portion 41*b* in which the noise-suppressing electrical cable 11 is held by press-fitting from above the coating 33. In this manner, the noise-suppressing electrical cable 11 can be firmly and reliably connected to the metallic connecting device 13.

When the noise-suppressing electrical cable 11 is press-fitted, the edge portion of detent 41*c* provided in the connecting device 13 penetrates into the outer circular surface of noise-suppressing electrical cable 11, so that the latter is prevented from being pulled out. Moreover, the detent 41*c* presses the outer circular surface of noise-suppressing electrical cable 11 constantly inwardly by its elastic force, so that the latter is kept stably in a pressed state even after a prolonged use.

Figure 11:
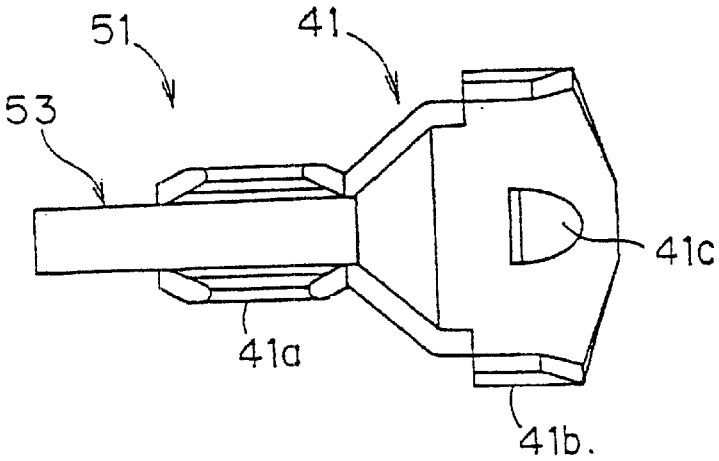
FIG. 11 is a top plan view of a second embodiment of the connecting device according to the present invention.
Figure 12:
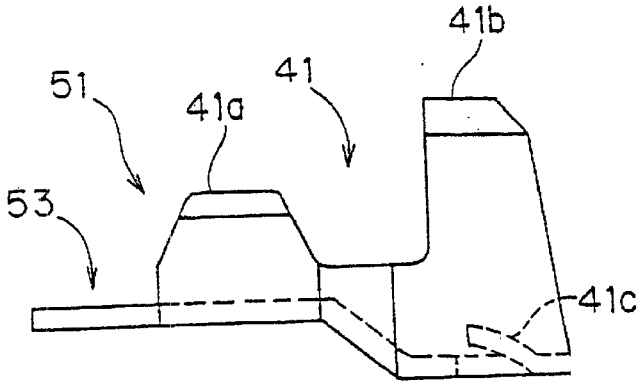
FIG. 12 is a side view of the second embodiment of FIG. 11, with hidden features shown in phantom.

FIG. 11 shows a top plan view of a connecting device 51 according to a second embodiment (first variant) of the present invention, while FIG. 12 shows a side view thereof. In this second embodiment of the connecting device 51, the cup-shaped solder connector portion 43 is replaced by a flat-type solder connector portion 53.

Figure 13:
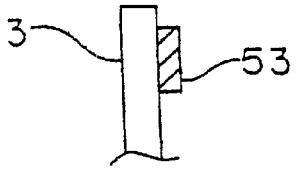
FIG. 13 is an end elevation view of the solder connector portion of the second embodiment of FIG. 11, when it is placed into contact with a connector portion of a transformer.
Figure 14:
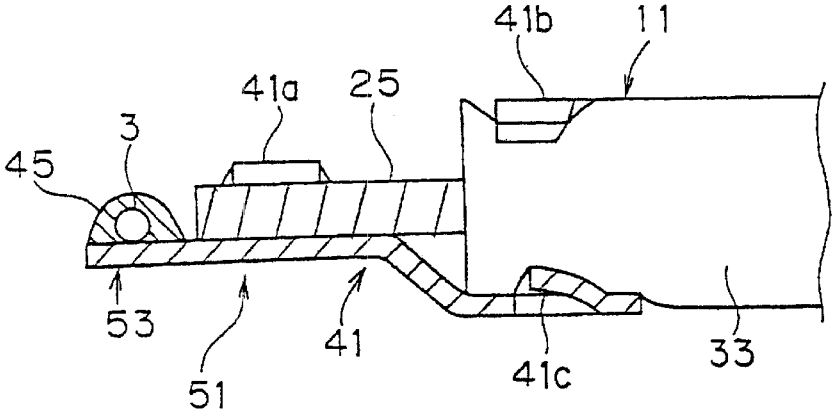
FIG. 14 is a cross-sectional side view of the second embodiment of FIG. 11, when the connecting device is soldered to the connector portion of a transformer.

As shown in FIGS. 13 and 14, when connecting the connecting device 51 of the second embodiment to the transformer 1, the flat-type solder connector portion 53 is placed into contact with the connector portion 3 of transformer 1 along its length direction, and soldered.

According to the method described above, the flat-type solder connector portion 53 of the metallic connecting device 51 of the second embodiment is very easily soldered to the connector portion 3 of transformer 1. Further, the flat-type solder connector portion 53 of the metallic connecting device 51 of the second embodiment has a simple, substantially flat shape. The shape of the metallic connecting device 51 constructed therewith can be simplified accordingly, and manufactured more easily.

Figure 15:
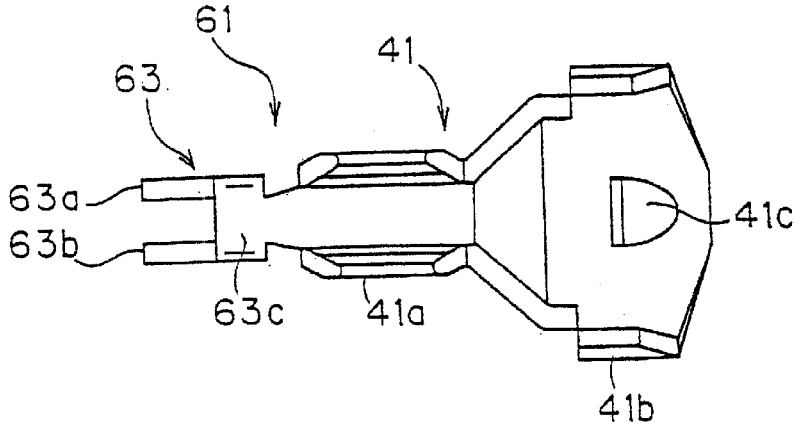
FIG. 15 is a top plan view of a third embodiment of the connecting device according to the present invention.
Figure 16:
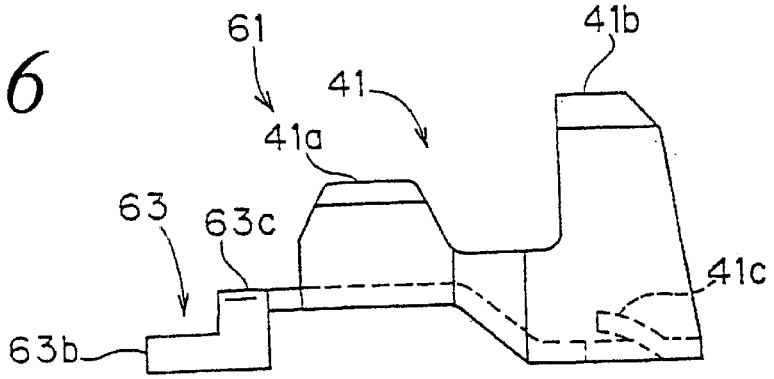
FIG. 16 is a side view of the third embodiment of FIG. 15, with hidden features shown in phantom.

FIG. 15 is a top plan view of a connecting device 61 according to a third embodiment (second variant) of the present invention, while FIG. 16 shows a side view thereof. In the connecting device 61 of the third embodiment, the cup-shaped solder connector portion 43 of the first embodiment is replaced by a lip-type solder connector portion 63 which includes a pair of lips 63*a* and 63*b* extending in parallel from the edge of the crimping connector portion 41.

The lip-type solder connector portion 63 includes a link portion 63*c* which leads to the edge of crimping connector portion 41, and a pair of flat lips 63*a* and 63*b*. The latter is formed by bending each lateral end of the link portions 63*c* downwardly (or upwardly). Both lips 63*a* and 63*b* protrude forwardly (in the insertion direction of the noise-suppressing electrical cable 11) from the link portion 63*c*. They face each other along their longitudinal direction over a distance slightly greater than the diameter of connector portion 3 of transformer 1.

Figure 17:
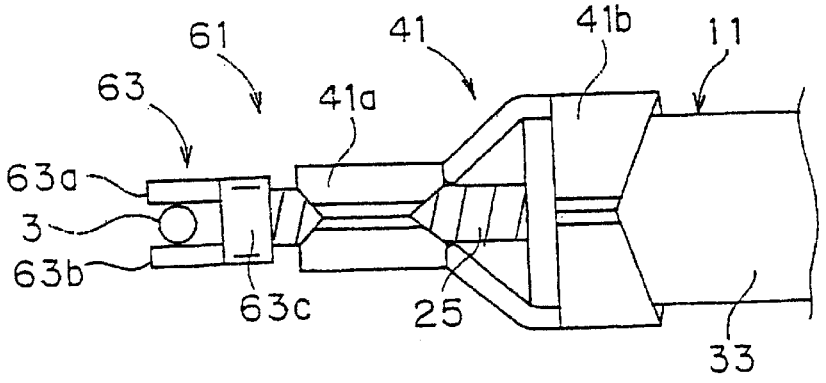
FIG. 17 is a top plan view of the third embodiment of FIG. 15, when it is placed into contact with a connector portion of a transformer.

As shown in FIG. 17, the connector portion 3 of transformer 1 is flanked by the respective lips 63*a* and 63*b* of the lip-type solder connector portion 6, and fixed thereto, whereby the connecting device 61 of the third embodiment is connected to the transformer 1.

According to the above embodiment, the connector portion 3 of transformer 1 is interposed between a pair of lips 63*a* and 63*b* of the lip-type solder connector portion 63 of the connecting device 61 of third embodiment, and they are soldered in place. As the connector portion 3 of transformer 1 and the lip-type solder connector portion 63 are positioned as desired beforehand, the soldering process is easily carried out. Furthermore, as the pair of lips 63*a* and 63*b* are soldered while flanking the connector portion 3 of transformer 1, the mechanical strength of the connecting portion is enhanced.

According to the present invention, a high-voltage electrical cable is connected to a transformer through a connecting device. By virtue of this configuration, the coiled-type high-voltage noise-suppressing cable can be used as a high-voltage electrical cable, resulting in a further enhanced noise suppression effect. Furthermore, the connections between the connecting device, the coiled-type high-voltage noise-suppressing cable and the transformer are made by a simple process such as crimping or soldering. As a result, the coiled-type high-voltage noise-suppressing cable and the transformer can be connected easily and reliably.

According to a first embodiment, the solder connector portion of connecting device is in the form of a cup provided with a through hole in its base center. A connector portion of the transformer, such as a rod-shaped terminal portion 3, is then passed through the through hole from the base side of cup-shaped solder connector portion, inserted there into, and soldered in this condition. As the solder forms a mass in the solder connector portion, the latter and the rod-shaped terminal portion are firmly soldered. Moreover, the soldering process is easily carried out by dripping molten solder from above the solder connector portion. The soldering process can thus be greatly simplified.

According to a second embodiment, the surface of the solder connector portion of the connecting device is placed into contact with the length direction of a connector portion of transformer 1 such as a rod-shaped terminal portion 3, and are fixed together by soldering. The soldering process can thus be carried out easily. Moreover, the solder connector portion of the connecting device is formed of a simple, substantially flat plate. By virtue of this simple construction of the solder connector portion, the whole structure of connecting device itself can be simplified. The metallic connecting device can thus be manufactured more easily.

According to a third embodiment, a connector portion of the transformer 1, such as a rod-shaped terminal portion 3, is inserted between a pair of lips provided in the solder connector portion of the metallic connecting device. The connector portion of transformer 1 and the pair of lips of the connecting device are soldered in this condition, so that the connector portion of the transformer and the solder connector portion of the connecting device can be positioned properly. By virtue of this configuration, the soldering process is easily conducted, and the mechanical strength of connected portions is improved. According to another embodiment, the crimping connector portion of the connecting device includes a first barrel portion, in which the coiled core element, prepared by baring the end portion of coiled-type high-voltage noise-suppressing cable, is held by press-fitting. The crimping connector portion further includes a second barrel portion, in which the coiled-type high-voltage noise-suppressing cable is held by crimping from above its coating. In this manner, the coiled-type high-voltage noise-suppressing cable is firmly and reliably press-connected to the connecting device.

Although the invention has been described with reference to particular means, materials and embodiments, it is to be understood that the invention is not limited to the particulars disclosed and extends to all equivalents within the scope of the claims.

What is claimed:

1. A metallic connecting device for connecting a high-voltage electrical cable to a transformer having a connector portion from which a high electrical voltage is transmitted, the high-voltage electrical cable including a coiled-type high-voltage noise-suppressing cable including at least a coiled core element containing a magnetic material and at least a conductive wire through which the high electrical voltage is passed, the conductive wire being wound around the magnetic material, and a coating covering the coiled core element, said connecting device comprising:

a crimping connector portion configured for press-fitting the coiled-type high-voltage noise-suppressing cable; and a solder connector portion extending from said crimping connector portion and configured for connecting to the connector portion of the transformer by soldering.

2. The connecting device according to claim 1, wherein the transformer is provided with an electronic part including a rod-shaped terminal portion and the connector portion of the transformer includes the rod-shaped terminal portion, said solder connector portion of said connecting device is generally cup-shaped having a base with a through hole, and wherein when said solder connector portion is connected to the connector portion of the transformer, the rod-shaped terminal portion extends through said through hole, and is soldered to said solder connector portion.

3. The metallic connecting device according to claim 2, wherein the coiled-type high-voltage noise-suppressing cable includes an end portion, the end portion being stripped of the coating so that the coiled core element is exposed, and wherein said crimping connector portion comprises a first barrel portion configured to receive the coiled core element of the coiled-type high-voltage noise-suppressing cable in press-fit engagement, and a second barrel portion configured to receive the coiled-type high-voltage noise-suppressing cable in crimped engagement with the coating.

4. The connecting device according to claim 3, wherein said second barrel portion comprises a base wall having a detent formed thereon.

5. The connecting device according to claim 1, wherein the transformer is provided with an electronic part including a rod-shaped terminal portion and the connector portion of the transformer includes the rod-shaped terminal portion, said solder connector portion of said connecting device is configured as a substantially flat plate to contact the rod-shaped terminal portion along the length direction thereof, and wherein the rod-shaped terminal portion is connectable and securable to said solder connector portion by soldering.

6. The connecting device according to claim 5, wherein the coiled-type high-voltage noise-suppressing cable includes an end portion, the end portion being stripped of the coating so that the coiled core element is exposed, and wherein said crimping connector portion comprises a first barrel portion configured to receive the coiled core element of the coiled-type high-voltage noise-suppressing cable in press-fit engagement, and a second barrel portion configured to receive the coiled-type high-voltage noise-suppressing cable in crimped engagement with the coating.

7. The connecting device according to claim 6, wherein said second barrel portion comprises a base wall having a detent formed thereon.

8. The connecting device according to claim 1, wherein the transformer is provided with an electronic part including a rod-shaped terminal portion and the connector portion of the transformer includes the rod-shaped terminal portion, said solder connector portion of said connecting device includes a pair of lips extending substantially in parallel, between which the rod-shaped terminal portion is insertable, and wherein the rod-shaped terminal portion is connectable and securable to said solder connector portion by soldering.

9. The connecting device according to claim 8, wherein the coiled-type high-voltage noise-suppressing cable includes an end portion, the end portion being stripped of the coating so that the coiled core element is exposed, and wherein said crimping connector portion comprises a first barrel portion configured to receive the coiled core element of the coiled-type high-voltage noise-suppressing cable in press-fit engagement, and a second barrel portion configured to receive the coiled-type high-voltage noise-suppressing cable in crimped engagement with the coating.

10. The connecting device according to claim 9, wherein said second barrel portion comprises a base wall having a detent formed thereon.

11. The connecting device according to claim 1, wherein the coiled-type high-voltage noise-suppressing cable includes an end portion, the end portion being stripped of the coating so that the coiled core element is exposed, and wherein said crimping connector portion comprises a first barrel portion configured to receive the coiled core element of the coiled-type high-voltage noise-suppressing cable in press-fit engagement, and a second barrel portion configured to receive the coiled-type high-voltage noise-suppressing cable in crimped engagement with the coating.

12. The connecting device according to claim 11, wherein said second barrel portion comprises a base wall having a detent formed thereon.

13. The connecting device according to claim 1, wherein said solder connector portion comprises an opening, and wherein when said solder connector portion is connected to the connector portion of the transformer, the connector portion is positioned in said opening, and is soldered to said solder connector portion.

14. The connecting device according to claim 13, wherein said solder connector portion comprises a planar portion extending between said crimping connector portion and said opening, and wherein when said solder connector portion is connected to the connector portion of the transformer, the connector portion extends in a direction to intersect said planar portion.

15. The connecting device according to claim 14, wherein said opening comprises a through hole, and wherein when said solder connector portion is connected to the connector portion of the transformer, the connector portion extends through said through hole and is soldered to said solder connector portion at said opening.

16. The connecting device according to claim 14, wherein said opening comprises a pair of lips extending substantially in parallel, and wherein when said solder connector portion is connected to the connector portion of the transformer, the connector portion extends between said pair of lips, and is soldered to said solder connector portion at said pair of lips.

17. The connecting device according to claim 1, wherein said solder connector portion comprises a planar portion extending from said crimping connector portion, and wherein said solder connector portion is configured to receive the connector portion of the transformer in a direction intersecting the plane of said planar portion.

18. The connecting device according to claim 17, wherein said solder connector portion includes a cup shaped portion extending from said planar portion, said cup shaped portion having an aperture therein to receive the connector portion of the transformer extending therethrough, and said cup shaped portion is configured to receive and hold solder for securely connecting said solder connector portion and the connector portion of the transformer.

19. A method of connecting a transformer containing a connector portion to a high-voltage electrical cable, said method comprising:

preparing a coiled-type high-voltage noise-suppressing electrical cable used as a high-voltage electrical cable, said coiled-type high-voltage noise-suppressing electrical cable including:

a coiled core element containing a magnetic material and a coiled portion, said coiled portion including a conductive wire through which a high electrical voltage is transmitted, said conductive wire being wound around said magnetic material; and a coating covering said coiled core element;

stripping said end portion of said coating so that said coiled core element is exposed;

preparing a metallic connecting device comprising:

a crimping connector portion configured for press-fitting said coiled-type high-voltage noise-suppressing cable;

a solder connector portion extending from said crimping connector portion and configured for connecting said connector portion of said transformer to said end portion of said coiled -type high-voltage noise-suppressing cable by soldering; and press-fitting said coiled-type high-voltage noise-suppressing cable in said crimping connector portion, and connecting and fixing said end portion of said coiled-type high-voltage noise-suppressing cable to said connector portion of said transformer by soldering at said solder connector portion;

whereby said transformed is connected and fixed to said coiled-type high-voltage noise-suppressing cable via said metallic connecting device.

* * * * *

UNITED STATES PATENT AND TRADEMARK OFFICE

CERTIFICATE OF CORRECTION

PATENT NO. : 6,335,489 B1
DATED : January 1, 2002
INVENTOR(S) : Y. Kobayashi et al.

It is certified that error appears in the above-identified patent and that said Letters Patent is hereby corrected as shown below:

Column 10,
Line 60, "transformed" should be -- transformer --.

Signed and Sealed this

Nineteenth Day of November, 2002

*Attest:*

*Attesting Officer*

JAMES E. ROGAN
*Director of the United States Patent and Trademark Office*